US005088858A

United States Patent [19]

Massoudi

[11] Patent Number: 5,088,858

[45] Date of Patent: Feb. 18, 1992

[54] METHOD AND APPARATUS FOR CONSTRUCTING A COLUMN-SHAPED MARINE STRUCTURE AND STRUCTURE PRODUCED THEREBY

[75] Inventor: Ahmad Massoudi, Tehran, Iran

[73] Assignee: Darya Paye Jetty Co., Ltd., London, Great Britain

[21] Appl. No.: 610,360

[22] Filed: Nov. 7, 1990

[30] Foreign Application Priority Data

Nov. 7, 1989 [NL] Netherlands ..... 8902752

[51] Int. Cl.[5] ..... E02B 17/02; E02D 5/18

[52] U.S. Cl. ..... 405/203; 405/196; 405/204; 405/205; 405/209; 405/222

[58] Field of Search ..... 405/195, 196, 199, 200, 405/203-207, 209, 218-225

[56] References Cited

U.S. PATENT DOCUMENTS

| | | | |
|---|---|---|---|
| 1,758,606 | 5/1930 | Jacobs . | |
| 2,050,727 | 8/1936 | Misz . | |
| 3,740,956 | 6/1973 | Guy et al. . | |
| 4,094,162 | 6/1978 | Allee | 405/207 X |
| 4,118,941 | 10/1978 | Bruce et al. . | |
| 4,118,942 | 10/1978 | Liautaud | 405/204 |
| 4,293,239 | 10/1981 | Petty et al. | 405/195 |
| 4,711,601 | 12/1987 | Grosman | 405/204 |
| 4,744,697 | 5/1988 | Coppens | 405/204 |
| 4,824,290 | 4/1989 | Masoudi | 405/203 |
| 4,923,334 | 5/1990 | Masoudi | 405/203 |
| 4,923,335 | 5/1990 | Massoudi | 405/204 |

FOREIGN PATENT DOCUMENTS

| | | | |
|---|---|---|---|
| 1279746 | 11/1961 | France | 405/203 |
| 1497544 | 10/1967 | France . | |
| 1386053 | 5/1975 | United Kingdom . | |

*Primary Examiner*—Randolph A. Reese
*Assistant Examiner*—John A. Ricci
*Attorney, Agent, or Firm*—Brumbaugh, Graves, Donohue & Raymond

[57] ABSTRACT

A method of constructing a column-like marine structure including the steps of constructing and placing an assembly of floats in a dry area, placing on the float assembly a column base having its own buoyancy, flooding the area to float the assembly of floats and column and moving them to deeper water, ballasting the floats to sink them and while maintaining buoyancy of the column removing the floats, completely ballasting the column to sink it, reconnecting the floats around the top of the column, constructing a further column part on top of the column, lifting the assembly by the buoyancy of the floats and/or the buoyancy of the column and floating it to a desired location in deeper water.

13 Claims, 10 Drawing Sheets

METHOD AND APPARATUS FOR CONSTRUCTING A COLUMN-SHAPED MARINE STRUCTURE AND STRUCTURE PRODUCED THEREBY

The invention relates to a method of manufacturing an artificial construction on the bottom of a body of water, such as an artificial island or the like, a column, a pile, a habour etc., in which a large part of the construction is manufactured at a distance from the location in an area which is free of weather circumstances which are disadvantageous for the work, and in which said part of the construction, after completion, in floating condition is moved towards the location and there is lowered upon the bottom of the body of water.

The term "artificial construction" covers arrangements, such as drilling platforms, platforms capable to withstand ice bergs, platforms for investigation or for military purposes.

A method of this type is known. For example, one did manufacture in a Norwegian habour a very large artificial island construction from concrete, towed in floating condition towards the location in the so called Ecofisk area of the Northsea and lowered it there by ballasting upon the bottom of the sea and anchored it.

It is evident, the manufacturing and in particular transportation of the entire island is a cumbersome and expensive affair. Moreover one usually is bound to a place of manufacturing, which place of manufacturing, in view of the often large height of such a construction, has to have a dock, within which at least the lower portion can be manufactured and which allows, by sufficient depth, to bring the entire construction in floating condition after completion.

The purpose of the invention is to provide a method which is simpler and accordingly less expensive and more flexible with respect to the area where the work has to be done.

This purpose is achieved in the first place in that primarily in the dry a series is manufactured of interconnectable pontoons or floats, said series of pontoons is placed on a working surface which can be brought below water surface or can get below water surface, on the upper surface of said series of pontoons a part of the construction is made at least comprising the lower portion of the construction to be manufactured and that this lower part is made such that it has its own buoyancy, subsequently the series of pontoons with upon it said portion is brought into floating condition and thereafter moved towards a water depth such that the portion of the construction can float in it with its lower edge spaced from the bottom a distance which is larger than the height of the pontoons, subsequently the pontoons are ballasted and removed, after which the floating construction is placed upon the bottom in quiet water and there at least one further portion of the construction is made, at least part of which is placed close to the outer wall of the construction and coupled therewith, that after completion of said further portion the construction with the aid of the buoyancy of the pontoons and/or its own buoyancy is moved towards the location.

This means that one can operate with all pontoons, which in that case accordingly are again placed around the construction, but as well that one provides the construction at the outer side with a ring guided upon it to which the pontoons can be connected or along which the pontoons can be moved according to the circumference of the ring, so that one only uses a part of the pontoons as working platform.

Herewith one in the first place achieves that the lower part or foot portion of the construction is manufactured in shallow water or in the dry on top of a series of pontoons, which rest upon a horizontal surface or a surface which is made horizontal.

This can be a shore area, subjected to tides, in which case one places the pontoons during low tide and are floated when time comes at high tide together with the already manufactured portion of the construction placed upon it.

Of course one can do this in dock as well, so that the work takes place completely in the dry, which dock later on is filled with water. In that case, however, need not have exceptional water depth.

It is possible as well, in particularly if tide differences are small so that the level is practically constant level, to work in shallow water in which case the pontoons are placed upon a horizontal or horizontally made bottom by ballasting the pontoons, after which again on top of the pontoons the lower portion of the construction is placed be it in its entirety or in part.

After the manufacturing of said lower portion the assembly of pontoons and lower portion standing upon it, is brought in floating condition towards deeper water, where the pontoons are removed by ballasting and subsequently the floating lower portion, as far as still necessary, is moved towards a place in quiet water where this portion is placed upon the bottom and one continues the assembly of the construction. The removed pontoons then can again be placed around the already manufactured portion and can be coupled therewith and function as working platform.

In case the construction is completed at the last mentioned place, at least as far as reaching the desired height is concerned, then with the aid of the buoyancy of said construction and the buoyancy of the pontoons coupled therewith, the construction can be towed towards the location of destination and there by ballasting and with the aid of means controlling the lowering movement lowered upon the bottom of the sea and subsequently anchored thereto.

As soon as the pontoons no longer are necessary, they are removed and one can complete the construction for the purpose it is meant for. If e.g. an artificial island is concerned filling, at least partly, with sand or the like, will take place, whilst moreover on top of it or inside the installations can be placed for which the construction is destined.

The present invention is particularly applicable to very large constructions having diameters of 100 to 200 meters and heights of 100 to 200 meters or more. Said dimensions, however, are in no way limitative, smaller or larger is possible as well.

If during manufacturing of said further portion of the construction the height and the local circumstances with respect to water depths prevents completion of the construction, then according to the invention one subsequently with the aid of the pontoons can move the construction towards deeper water, where the already manufactured portion is lowered upon the lower bottom of water and a next portion of the construction is made on top of the already manufactured portion. The steps of floating, displacing, lowering and further completing then are repeated as often as necessary until the construction can be moved towards the location of destination or can be completed there.

Most shores are bordered by an area having a width of tenths of kilometers with gradually increasing depths, due to which at many places one has the possibility to complete the construction, such as the artificial island step by step in height. The pontoons then are rigidly interconnected and form e.g. an endless series and the coupling of the pontoons with the construction takes place such, that only a controllable relative vertical movement between construction and pontoons may be possible. In other words the pontoons are guided upon the construction for vertical guidance, which construction to this end has been provided with guiding members. Accordingly the pontoons only can move in a vertical direction with respect to the construction and the reverse. Movements away from each other or towards each other are not possible.

A simple control of the relative position can be achieved according to the invention in that the coupling in the vertical sense is obtained between pontoons and construction by means of cables, one end of which being connected to the foot of the construction and the other end to winches which are placed upon the pontoons and by means of which from the pontoons cable by cable a controllable tension can be performed.

Accordingly with the invention one has the possibility to manufacture on a series of rigidly interconnected but disconnectable pontoons a first portion of a large construction to be placed in the sea. Subsequently, after placing of said construction on a working bottom, accordingly after removal of the pontoons, said construction by means of the pontoons now placed around it, which pontoons serve as working platform, is completed, is displaced with the pontoons towards deeper water and, if this is done in steps, the construction is also completed step by step in height, and finally the construction with the aid of its own buoyancy and the buoyancy of the pontoons is moved towards the location of destination. There the pontoons finally will be removed for repeated use.

An artificial construction of the type meant here and of the dimensions which can be large, may have any desirable circumferential shape, seen in the horizontal plane. This can be a circular circumference, a polygonal circumference, a rectangular circumference, an oval circumference or even the circumference of a habour having two jetties and an interconnecting portion (U-shape).

The pontoons form the apparatus for manufacturing the column or similar construction upon the bottom of a body of water and known is an apparatus comprising at least two pontoons which can be coupled with each other and define a space within which the construction can be made and can be displaced in vertical direction with respect to the pontoons. Such an apparatus has been described in U.S. Pat. No. 4,923,335.

With said known apparatus a portion of a column is made by making use of two pontoons whilst the pontoons are supported upon the bottom of the body of water; then, with the column portion still extending above the pontoons a further portion is constructed on top of it, whereby by repeating the operations the columns is completed step by step.

During the first step the pontoons rest upon the bottom of the body of water and are displaced as well by increasing their buoyancy, but they have their working surface above water. With very large constructions of the magnitude indicated it would make no sense to operate with two pontoons which together define a hollow space within which the construction has to be made. The two pontoons would together have to have dimensions in transverse direction larger than the outer diameter of the construction to be made and accordingly would themselves have unmanageable dimensions.

According to the invention apparatus is provided which comprises a plurality of pontoons which in coupled condition together form an endless closed series the inner circumference of which corresponds to the contours of the outer circumference of the construction to be manufactured. If e.g. the intended construction has a circular circumference then a circular ring is made from pontoons and said pontoons then have a curved inner surface, side faces in radial planes and an outer surface which can be curved, but need not to be.

If a polygonal is concerned then the most suitable form of the pontoons is the one of an equal sided trapezium of which the small one of the two parallel sides lies against a side surface of the polygonal circumference of which the large parallel side forms the outer surface.

Since the construction to be manufactured may have any circumferential shape, it of course is feasible that the pontoons have other shapes, which in top view may be square, triangular, unequally sided trapezium, rectangular trapezium, with or without straight or curved surfaces.

According to the invention each of the pontoons have been provided with guiding means, which cooperate with guiding members on the construction and closed by the pontoons and which only allow relative movement in vertical direction.

Each of the pontoons moreover can be provided with means by means of which a relative displacement upwardly as well as downwardly can be performed and by means of which the pontoons can be locked with respect to the construction.

In its most simple form said means comprise cables, which with their free end are connected to the foot of the construction and with their other end to a winch and that each pontoon has at least one winch with cable.

It, however, is feasible as well that said means comprise a climbing mechanism having a toothed rod or the like at the outer side of the construction and a drivable and lockable gear wheel mechanism upon or in each pontoon respectively, or that said means comprise a climbing mechanism of the type having locking beams and displacement cylinders by means of which a stepwise relative displacement can be performed. The climbing mechanism mentioned above with toothed rod and gear wheels which preferably are driven by hydraulic motors, or the climbing mechanism comprising cylinders and locking beams is known in itself with artificial islands of the "jack-up" type, comprising a pontoon and at least three legs, which with the aid of said climbing mechanism can be moved in vertical direction with respect to the pontoon and can be locked.

Said means can be applied with the present invention, but are relatively expensive as compared to winches with cables.

The pontoons in coupled condition have to form a rigid entity. To this end they are mutually interconnected by means of flanges at the end faces or side faces and by means of tension anchors at the location of at least the top surface, which anchors bridge the flange connection.

Under the influence of wave forces the rigid ring of pontoons will be subjected to bending forces, which result in tension forces and pressure forces at the location of upper and bottom surface. The tension anchors do support here the taking up of the occurring forces.

The method described before as well as the assembly of pontoons can be used for placing constructions of different design such as an enlarged version of the columns described in U.S. Pat. No. 4,824,290.

Since the present invention deals with very large constructions the method of the invention is particularly suitable for the manufacture of a structure having a hollow wall closed at the bottom and open at the top and with a sharp lower edge. According to the invention the method can be performed such that each inner wall and each outer wall of the double wall is a double wall itself, said last mentioned double wall at least in vertical direction being locally interconnected by double transverse walls and that the walls of the double walls of outer wall, inner wall and transverse wall are interconnected by anchors, said last mentioned double walls provided with anchors being fillable with a hardening material, such as concrete. Said inner wall and outer wall respectively, made as double walls, then form spaces which, as need may be, one fills with concrete whereas the remaining free spaces are ballasting spaces which as desired can be filled with water or emptied by pumping to control buoyancy or, in the exceptional case that one wants to regain the construction.

Where the risk of freezing exits said free spaces can be ballasted with sand or other like material.

In this way one obtains a very strong entity, which moreover can be reinforced further by the measures to be described hereinafter.

Thus the outer wall of the construction for coupling with a pontoon may be provided with at least one hollow profile having guiding edges externally for cooperation with the guiding means which grip around it of the respective pontoons. Preferably two hollow profiles are provided for each pontoon to obtain the best possible guidance which prevents jamming. The hollow profile not only guides but is a reinforcement rib as well upon the outer surface of the respective surfaces of the construction. Of course the construction is made from plates which provide tight walls.

Of course said profiles at the outer side can at a suitable moment be provided with a reinforcement and/or filling with concrete.

Furthermore it is possible according to the invention to provide the inner wall of the construction with spaced apart hollow profiles as well which extend from top to bottom and are open from top to bottom. These are continuously open profiles which apart from the function of reinforcing the inner wall may be used for other purposes.

If one imagines that the construction has a diameter of e.g. 100 meters then it will be clear that the distance between the inner and outer walls is of a magnitude of 15 to 20 meters and that each inner wall or outer wall respectively, made as double wall, has a thickness of 1.5 to 2 meters.

Hollow profiles which then may be used for reinforcement soon will have dimensions of 50 to 100 cm square and this opens the possibility for the following purposes.

Thus one may use said hollow profiles at the inner-side of the construction after its placing on the bottom for guiding a suction conduit or for guiding a pressure conduit. The construction does have a sharp lower edge and upon placing it upon the bottom of the body of water will partly penetrate into said bottom. It, however, will be necessary to take care that the axis of the constructioncis correctly vertical. This may involve the need of treating the bottom but since this has to take place at large depth this hardly can be done previously. However, if one has placed the construction with its sharp edge upon the bottom water and said construction did partly penetrate into it then one can, where necessary, by means of said hollow profiles with suction conduits remove sand, or by means of pressure conduits apply sand or hardening substances. Said substances then are applied below the inclined inner surface of the sharp lower edge and accordingly enlarge the foot. Through said channels one also can inject hardening substances into the underground.

After completion of the construction said hollow profiles may still be used for performing drillings and if necessary for extending through it a riser or production conduit. This of course depends on the destination of the construction.

Also, depending on the purpose of the structure, additional upper structure may be assembled on top of the construction.

It is possible to make use of transverse beams which bridge the space between opposite walls, in particular the inner walls, to form a working platform or support in the center of which a construction crane may be provided.

The invention now will be further elucidated with reference to the drawings.

FIGS. 5(*a*) to 5(*e*) show in top view different shapes, not limitative, of pontoons to be applied.

FIGS. 6(*a*) to 6(*e*) show in top view, non limitative, circumferential shapes of constructions to be made.

FIGS. 7(*a*) to 7(*e*) show possible cross sections in the vertical plane, in particular of the lower portion, non limitative as well.

Figure 8:
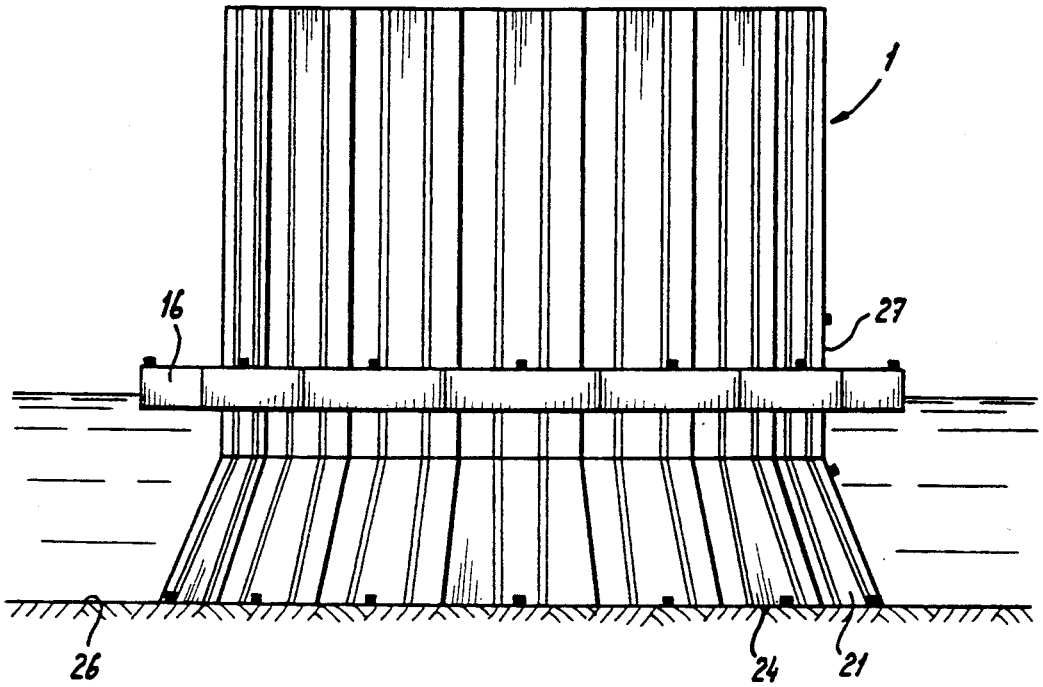

FIG. 8 shows in side view a step of the method.

Figure 9:
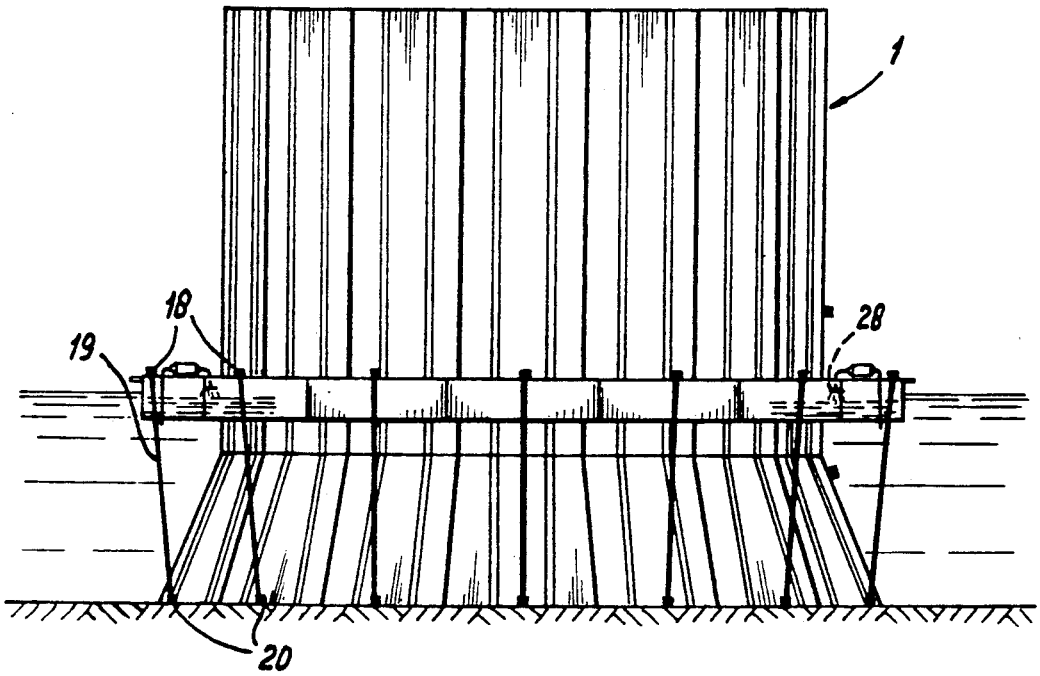

FIG. 9 shows in the same way as FIG. 8 a further step of the method.

Figure 10:
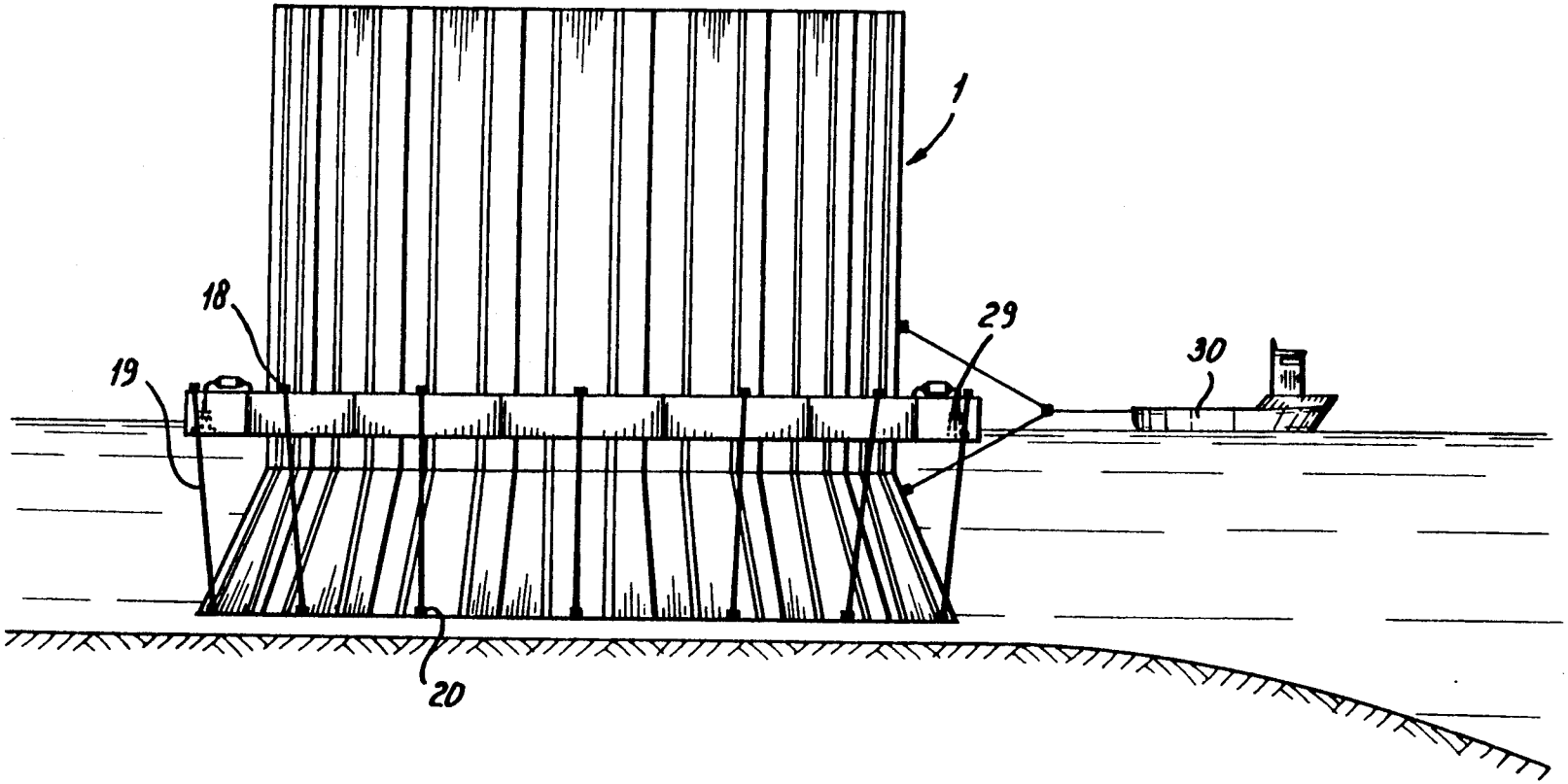

FIG. 10 shows in the same way as FIGS. 8 and 9 still a further step of the method.

Figure 11:
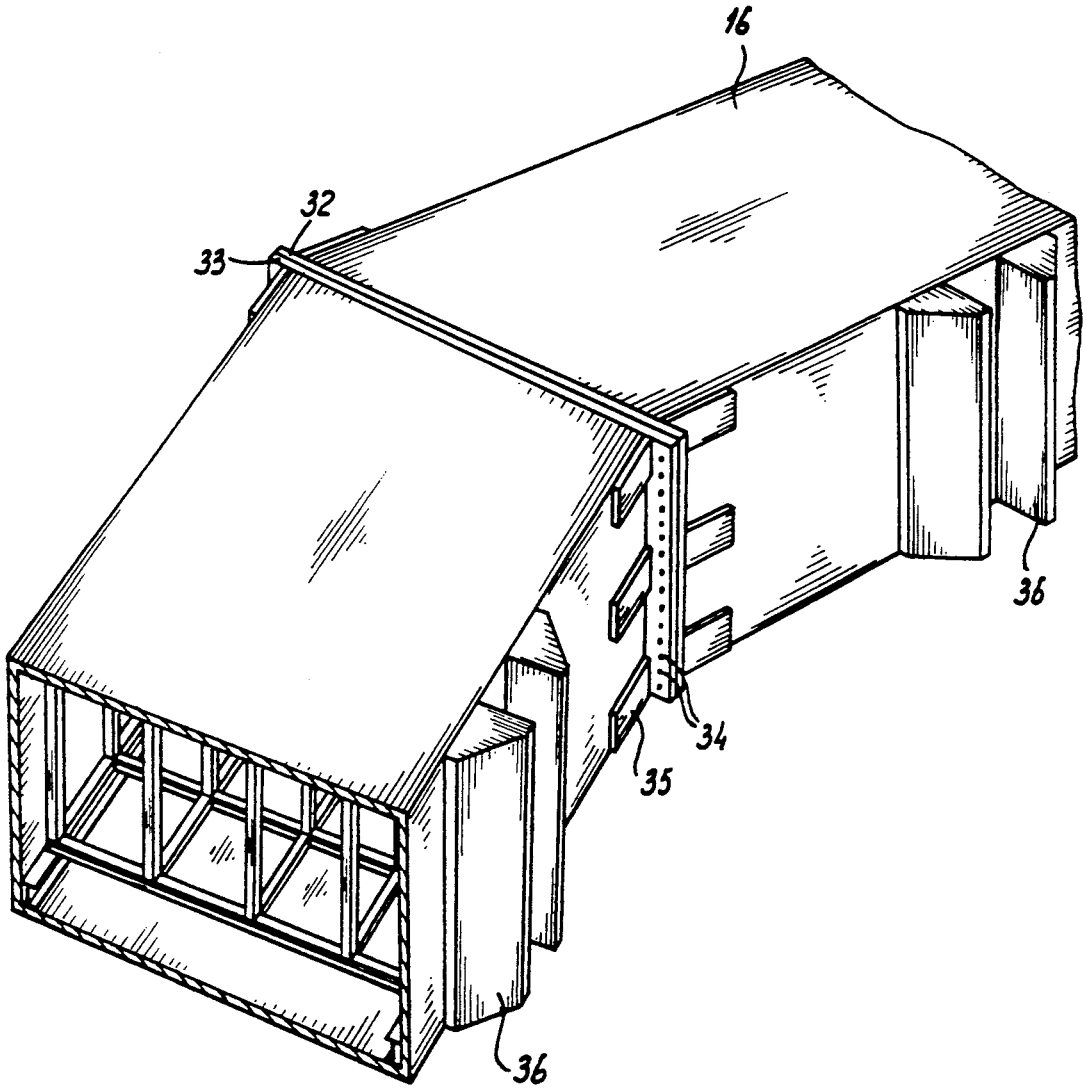

FIG. 11 shows in perspective a possible coupling of pontoons.

Figure 12:
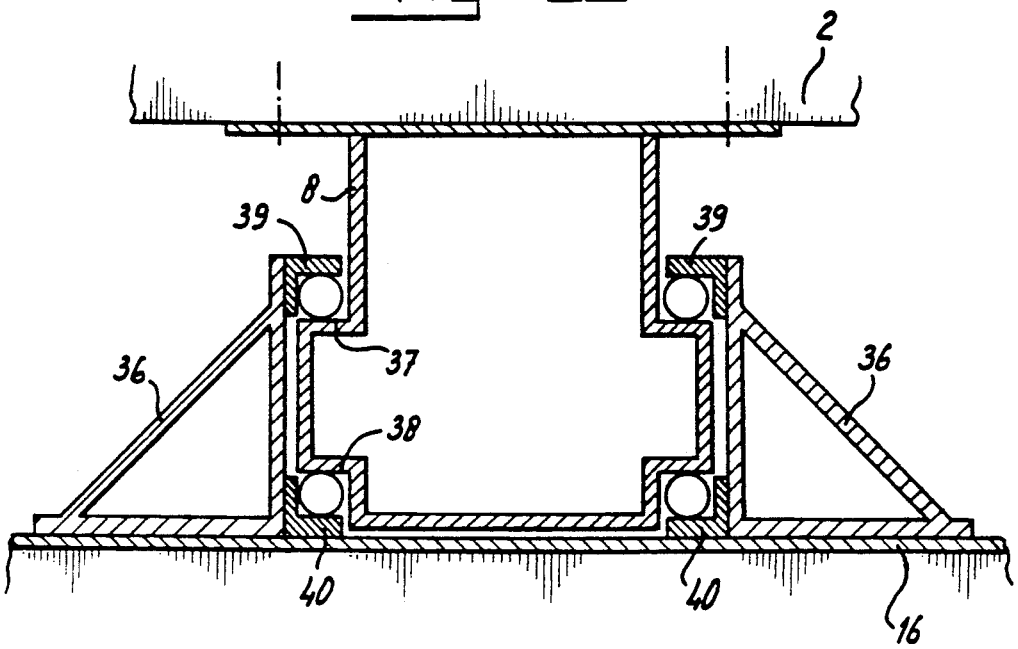

FIG. 12 shows in horizontal cross section a possible guiding of the pontoons upon guiding profiles of the construction.

Figure 1:
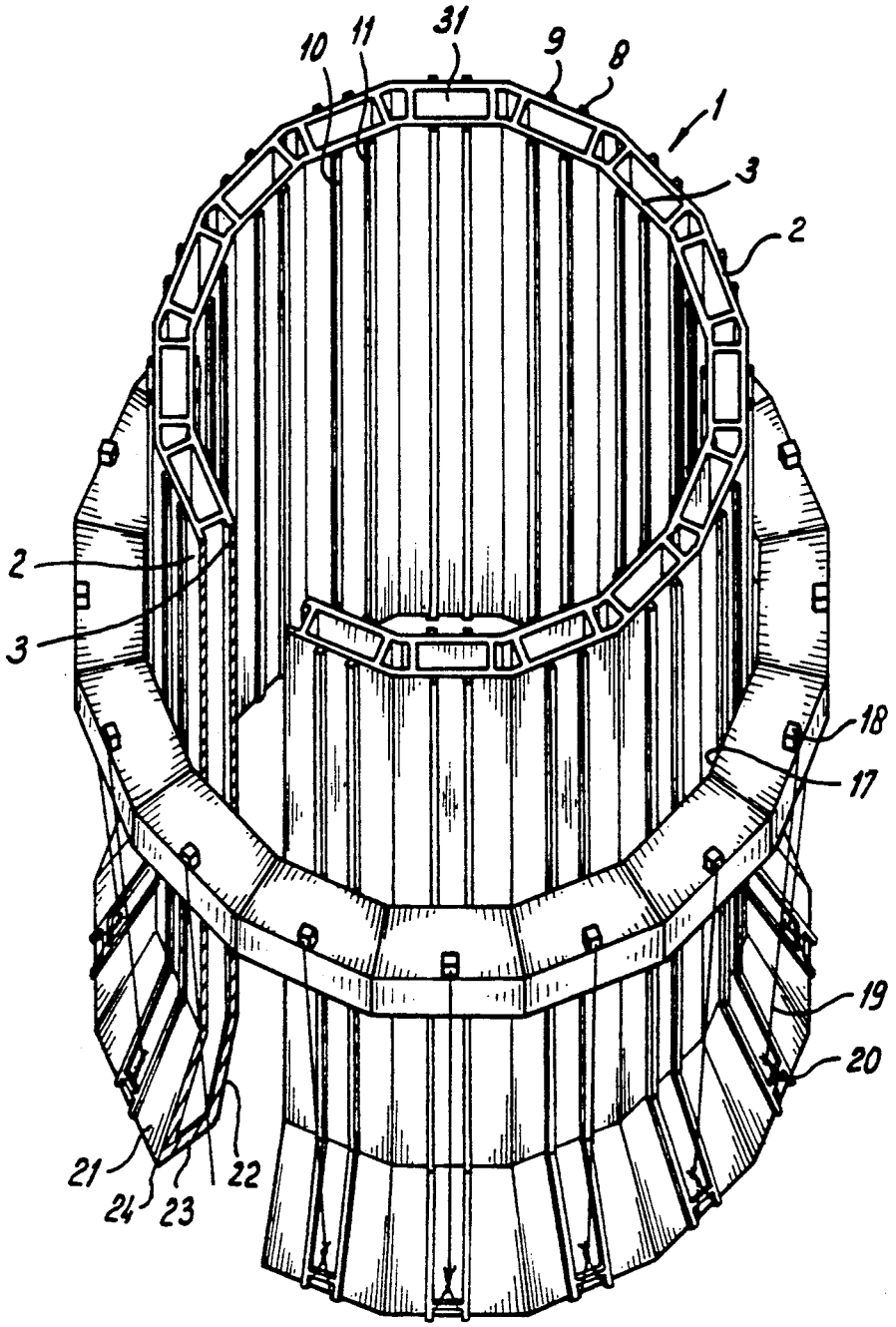
FIG. 1 is a diagrammatic view in perspective of a construction obtained with the method according to the invention and to be manufactured with the apparatus according to the invention, in which for the sake of clarity part of the wall is taken away.
Figure 2:
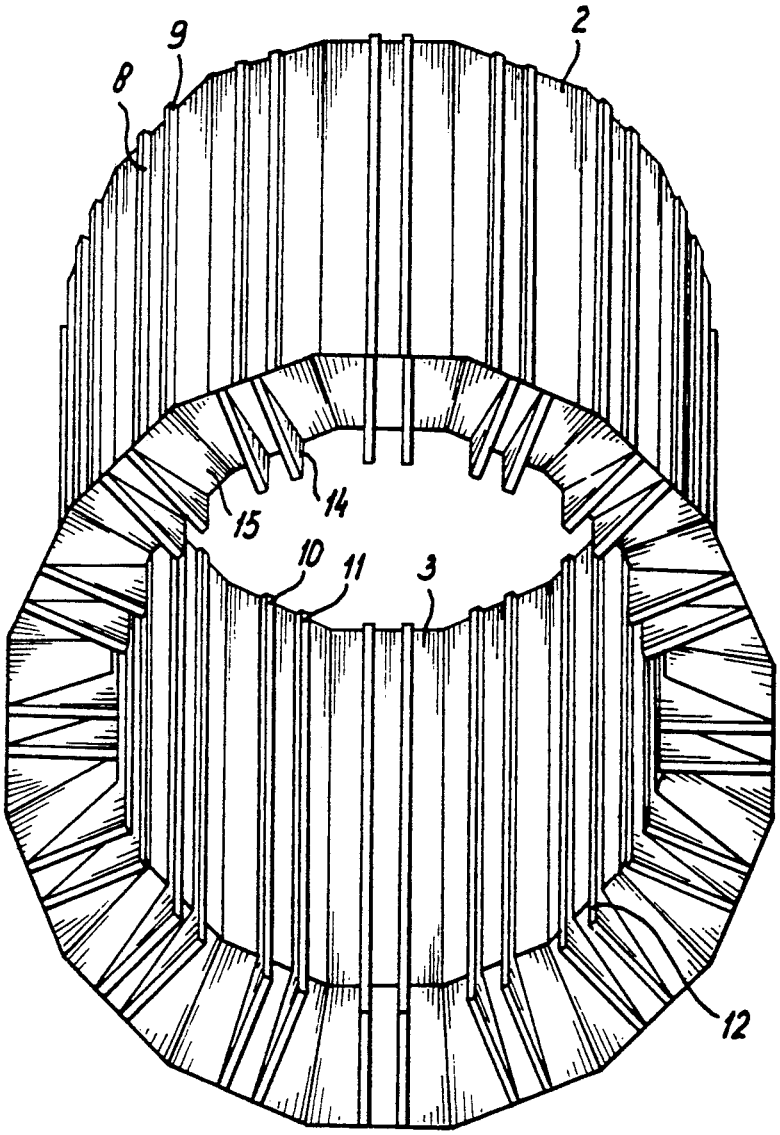
FIG. 2 shows the construction of FIG. 1 in a perspective view from the underside.
Figure 13:
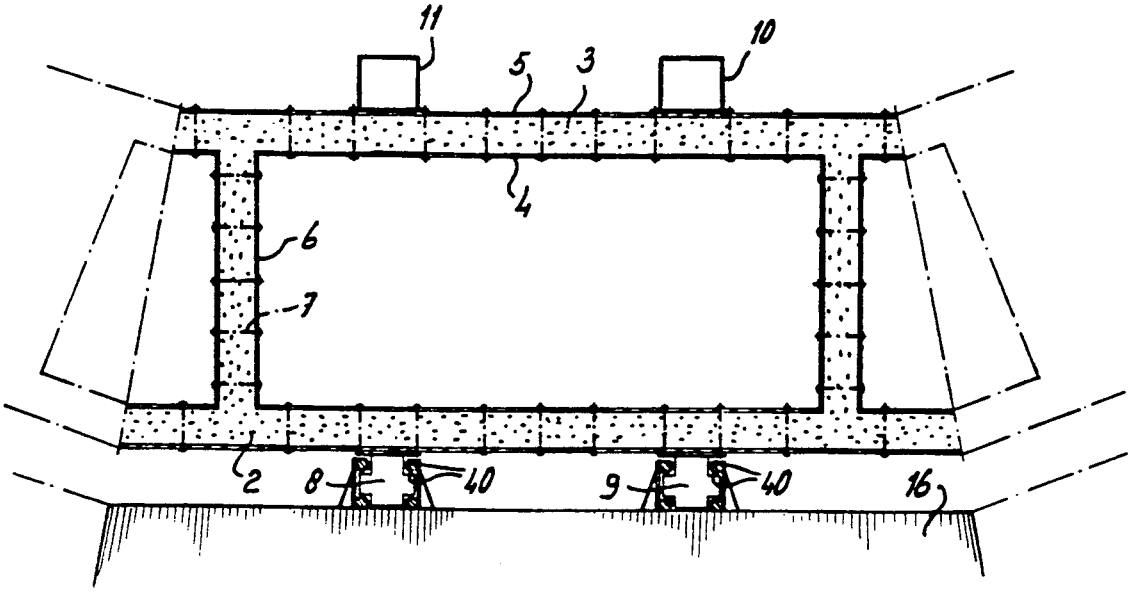

FIG. 13 shows in larger scale than FIG. 1 a horizontal cross section through a part of the wall of the construction to be made.

Figure 14:
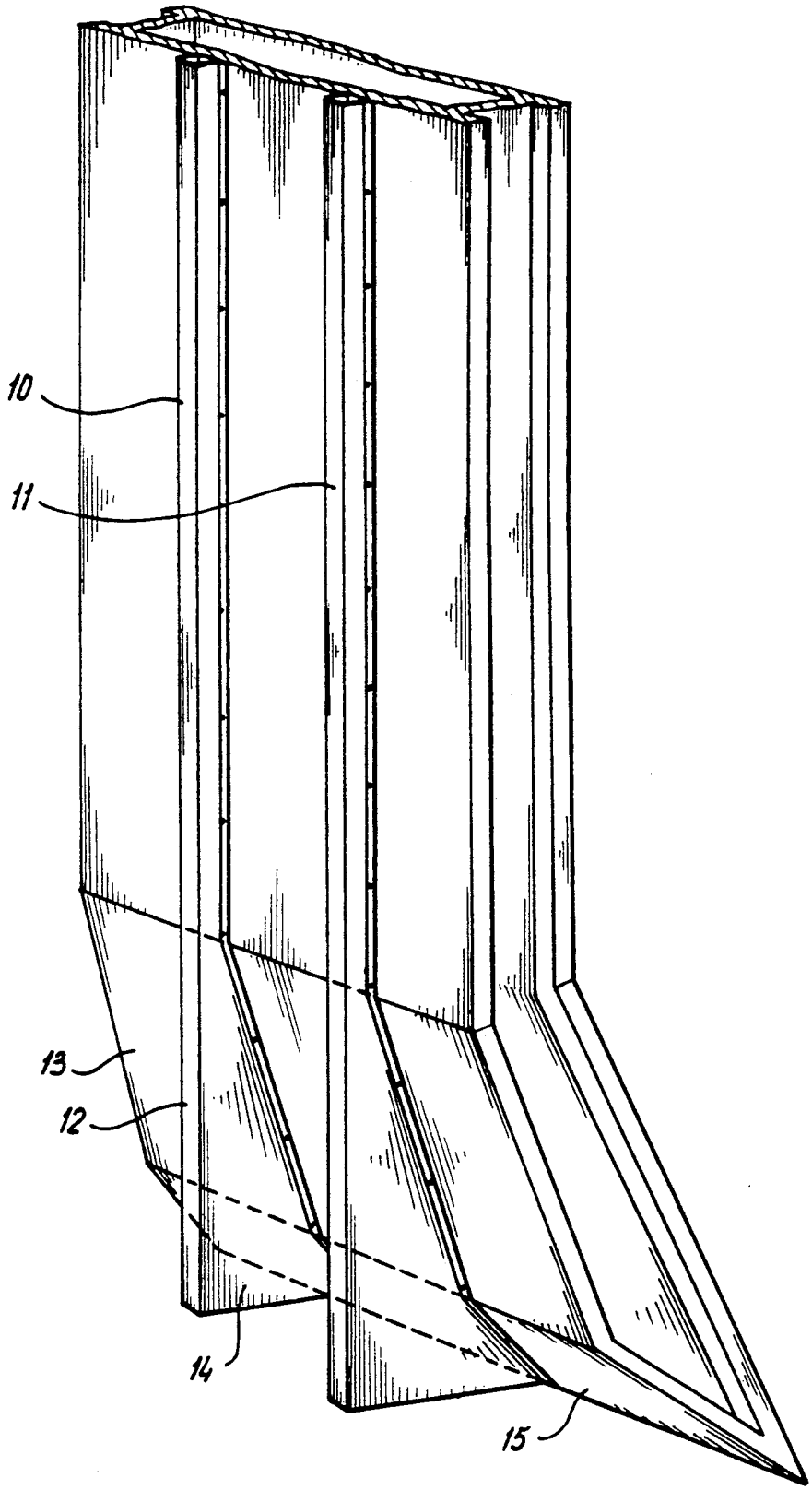

FIG. 14 is a perspective view of a part of the inner wall of the construction shown in FIGS. 1 and FIG. 13.

FIG. 1 generally shows the structure 1 to be manufactured, which structure is to be placed upon the bottom of a body of water, not shown. The structure has a polygonal circumference with an outer wall 2 and an inner wall 3, which as clearly shown in FIG. 13, are each made as a double wall with an inner plate 4 and an outer plate 5. The outer wall and inner wall are interconnected by transverse walls 6, which are formed as double walls as well and lie in planes, which are perpendicular to the inner and outer surface respectively. Said perpendicular position of course is not necessary. The transverse walls 6 moreover need not extend over the entire height, it being feasible is to interrupt them locally.

The double walls are destined to be filled with concrete in the course of the manufacturing procedure, the degree of filling and the moment of filling depending on the need for buoyancy and for ballasting respectively.

A plurality of anchors 7, only a few of which are shown in FIG. 13, extend the walls of the double walls.

Upon each flat surface of the outer wall which forms part of the polygonal circumference two hollow profiles 8 and 9 are provided, the cross sectional shape of which is shown in a simplified way in FIGS. 1 and 13, but of which a possible more precise cross sectional shape is found in FIG. 12.

Each flat face of inner wall 3 is also provided with hollow profiles 10 and 11 which need not serve a guiding function.

As may be seen from FIG. 14 said profiles 10 and 11 respectively extend vertically downwardly with the inwardly turned surface 12 extending vertically at the location of the inclined inner side 13 of the foot of the construction, so that below said foot an enlargement of the profile is formed in the form of a hollow casing 14.

Through said hollow profiles 10,11 and the casings, such as 14, a suction conduit can be guided, not shown, or a pressure conduit, not shown, by means of which sand can be withdrawn from below the inner surface 15 of the inclined foot or by means of which filling substances, like sand or the like, can be introduced below the foot or by means of which hardening substances can be supplied or injected.

As FIG. 1 shows, the construction is surrounded by an annulus of pontoons 16, which in top view have the shape of an equally sided trapezium the short parallel sides 17 of which have a length which corresponds to the width of the planar surface 2 of the outer wall of the polygonal circumference of the construction.

Said pontoons are rigidly coupled with each other in a manner shown in FIG. 11 and are guided upon the profiles shown in FIG. 12 by guiding means shown in more in detail in FIG. 12.

Each pontoon supports at least one winch 18, which is connected by means of a cable 19 with the lower part or foot 20 of the construction.

By virtue of said cables the pontoons can support the construction with or without help of the buoyancy of the construction itself. Said pontoons may have different shapes, a number of examples of which are shown in top view in FIGS. 5*a* to 5*e* inclusive.

The shape selected is determined by the shape of the circumference of the construction to be made of which a number of examples are given in FIGS. 6*a* to 6*e* inclusive, such as circular, polygonal, rectangular, oval, U-shaped.

FIG. 1 shows, where a part of the wall is broken away, in vertical cross section the profile of the construction with an outer wall 2 perform as double wall and an inner wall 3 perform as double wall.

The construction shown in FIG. 1 has in the upper portion parallel extending vertical inner and outer walls which in the lower portion merge into an inclined downwardly extending outer surface 21, a slightly less inclined inner surface 22 which further downwardly merges into an inclined surface 23, which forms a sharp lower edge 24 with the surface 21.

Figure 7A:
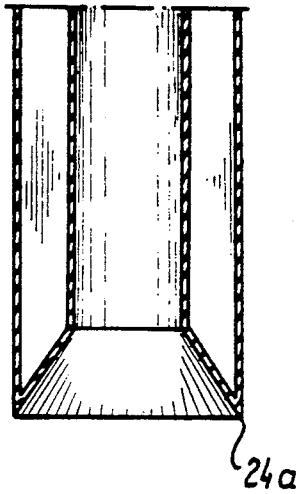
Figure 7B:
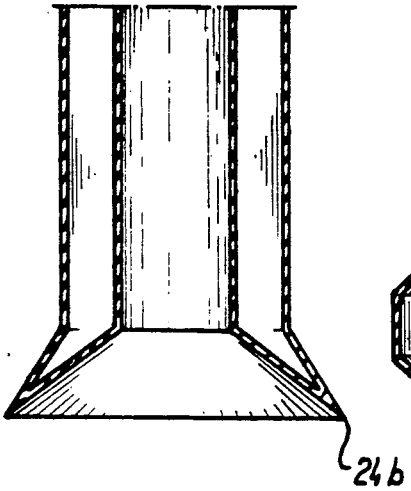
Figure 7C:
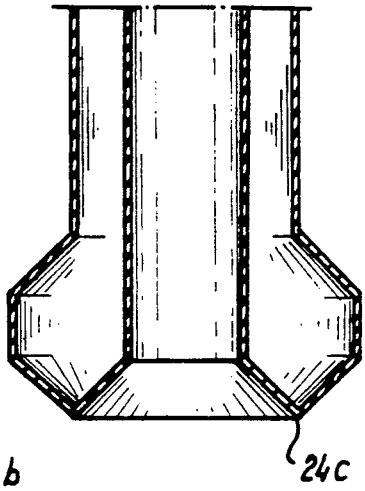
Figure 7D:
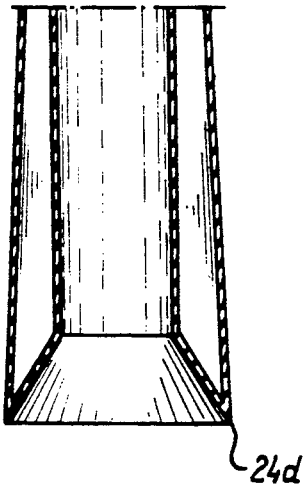
Figure 7E:
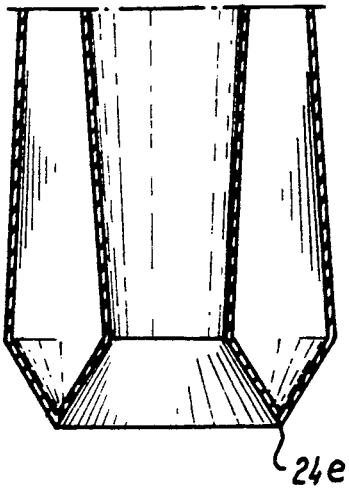

FIGS. 7*a* through 7*e* show, possible cross sectional shapes of the lower portion each having a sharp lower edge 24*a* to 24*e* respectively and having side walls in the upper portion which extend vertically and parallel to each other in FIGS. 7*a* to 7*c*, inclusive, or are inclined toward each other as shown in FIGS. 7*d* and 7*e*.

Figure 3:
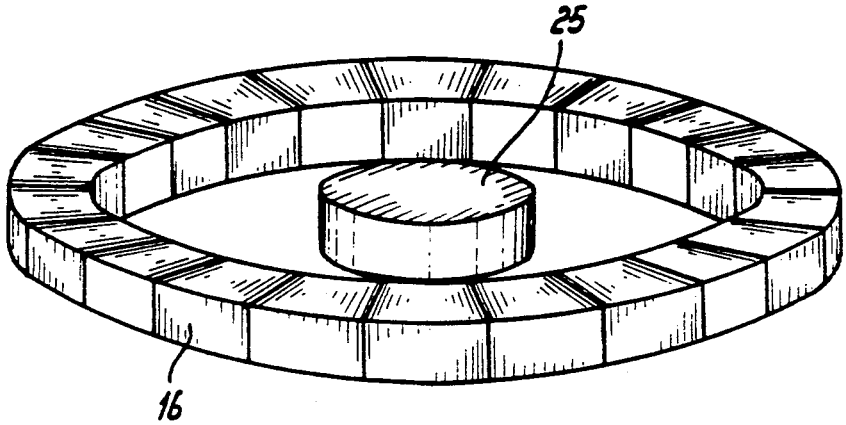
FIG. 3 shows diagrammatically a first step of the method according to the invention.

According to a first step of the method according to the invention shown in FIG. 3 an annulus of pontoons, such as the pontoons 16 of FIG. 1, is placed upon a horizontally made surface of e.g. a shore area subjected to tides. The pontoons are manufactured in the dry and during low tide care is taken that the bottom upon which the pontoons are to be placed in flattened. The annulus of pontoons is placed on the bottom during low tide and one takes care that during high tide the annulus of pontoons remains in place by ballasting, such as filling with water or placing weights upon it.

Figure 4:
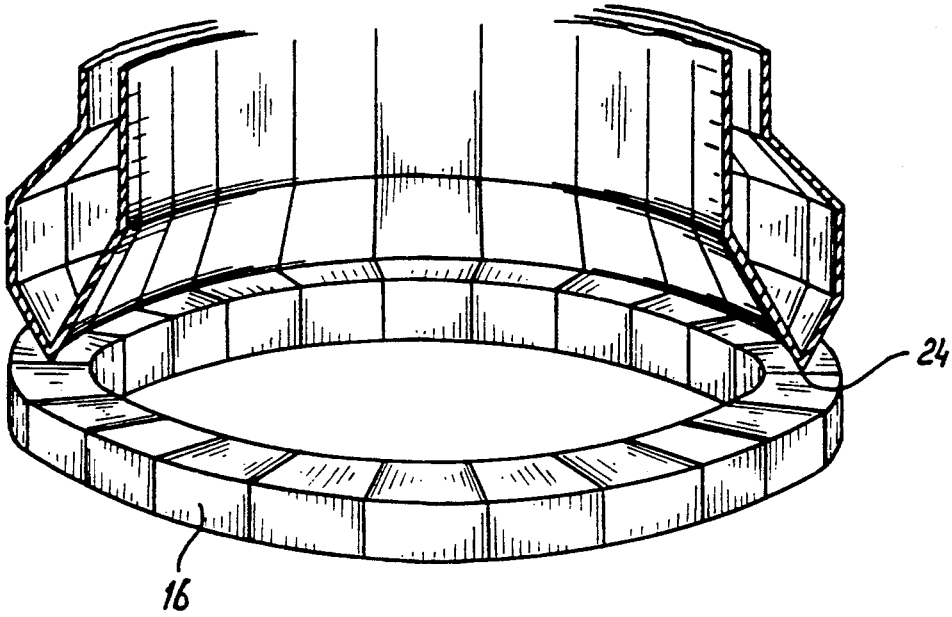
FIG. 4 shows diagrammatically a second step of the method according to the invention.
Figure 5A:
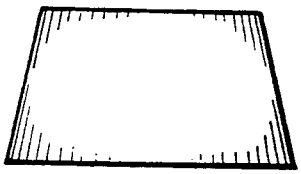
Figure 5B:
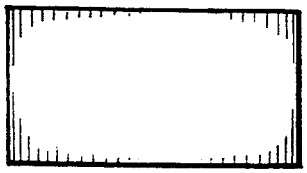
Figure 5C:
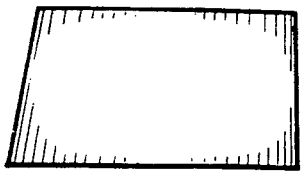
Figure 5D:
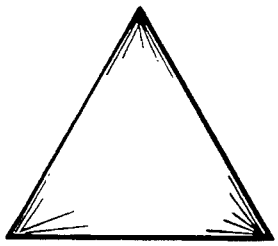
Figure 5E:
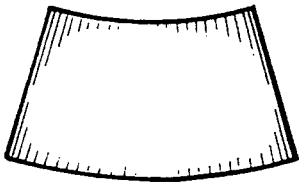
Figure 6A:
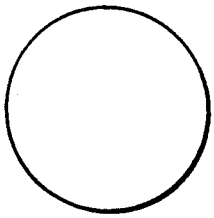
Figure 6B:
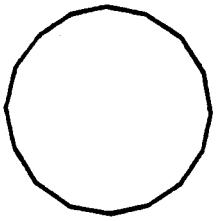
Figure 6C:
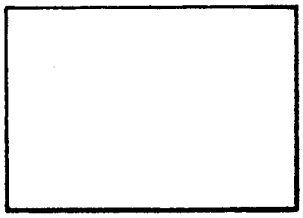
Figure 6D:
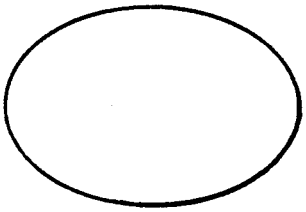
Figure 6E:
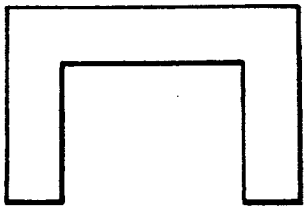

During another period of low tide or high tide an already manufactured lower portion of the column-like structure is placed upon said annulose of pontoons as shown in FIG. 4 in which for the lower portion a shape which is similar to the shape shown in FIG. 7*c* has been chosen. The diameter at the location of the sharp lower edge is larger than the inner diameter of the annulus of pontoons and smaller than the outer diameter of said annulus of pontoons such that said lower portion can stand upon it. The outer diameter of the outer wall of the upper portion preferably is such that said outer diameter in principle corresponds to the inner diameter of the annulus of pontoons, so that said annulus of pontoons during a later step of the method can be applied around the outer wall.

The hollow foot, shown in FIG. 4, has a shape and a water displacement such that it has buoyancy.

If in the practice of the method the annulus of pontoons is placed in a tide area then it is desirable that the assembled lower portion of the construction as such or easily connectable portions of the lower portion be placed upon the annulus of pontoons so that the operations of the work can take place within the time period of low tide.

As shown in FIG. 3, a platform 25 may be placed in the center of the annulus which, if needed, can be removable.

On the other hand, if one operates in the dry, e.g. in a dock, then the lower portion can be assembled piece by piece on top of the annulus of pontoons.

If, however, operation takes place in the wet with pontoons remaining below water level constantly then it is preferred to prefabricate the lower portion entirely and place it upon the pontoons.

After having finished assembly of the lower portion on the top of the annulus of pontoons the annulus is displaced. by floating the pontoons by taking away the ballast and with sufficient water level, which happens automatically in tide areas.

The assembly then is brought towards deeper water, the pontoons are ballasted again until the lower portion of the column-like structure floats, after which the pontoons are drawn away from below the floating lower portion. The lower portion is then moved towards a place with quiet water, e.g. a harbour if not already there. This lower portion is then lowered by ballasting onto the bottom of the water after which situation diagrammatically shown in FIG. 8, is generated in which the sharp lower edge 24 of the lower portion 21 stands upon the bottom 26 of the body of water, preferably with part of the upper portion 27 extending above water.

The annulus of pontoons 16 then is placed around the upper portion and this upper portion is further built upwardly.

If in the light of the occurring circumstances has been continued upwardly far enough then the pontoons in the manner shown in FIG. 9 are connected by means of the cables 19 with the foot 20 and tensioned by means of the winches 18.

The pontoons are then ballasted by pumping water into them as indicated at 28, so that they come to lie deeper into the water as shown in FIG. 9.

If thereafter water is removed, as indicated at 29 in FIG. 10, then the pontoons will lift the construction and permit it to be displaced with the aid of one or more two boats 30.

The displacement is towards deeper water where the construction is lowered to the bottom with the aid of cables with or without support by supplying water into the ballast spaces 31 (FIGS. 1 and 13). These operations can, if desired, by repeated several times.

FIG. 11 shows a possible arrangement for of coupling the pontoons 16 together. The pontoons are provided with side surfaces turned towards each other and provided with flanges 32, 33 with coupling means, not shown, which could be formed by bolts which e.g. according to line 34 extend through holes through the flanges.

Should the bolted flange connection be insufficient for taking up the forces generated by wave movements, tension anchors 35 are applied, which with their outer ends are connected to the upper surface and lower surface (not shown) of the pontoons.

Guiding means shown diagrammatically at 36 are provided on the inner wall of each pontoon for guiding the pontoon upon hollow profiles 8 and 9 provided at the outer side of the construction.

A possible cross sectional shape for the guiding means 36, is shown in FIG. 12, as attached to a piece of the outer wall plate of the construction and 17 is the surface of a trapezium shaped pontoon 16 turned towards it.

The hollow profile, such as 8, has, as shown in FIG. 12, such a horizontal cross section that guiding surfaces 37 and 38 are formed which extend perpendicular to the side faces of the hollow profiles 8.

The guiding means 36 of FIG. 11 have profiles 39 and 40 connected thereto. Said profiles with the walls of the hollow profiles form a hollow space within which rolling guiding means can be provided.

In their most simple form said profiles 39 and 40 have horizontal transverse surfaces at the outer ends, so that a closed chamber is formed. In said chamber rolls, such as balls, can be placed which then take care of a guidance with lower friction. If rolls are used which are enclosed in a fixed path, some friction of the rolls over at least one of the relatively movable surfaces cannot be excluded. Since the movements concerned are slow this need not to be an objection.

If this, however, could be an objection then one can provide in the space formed e.g. between profile 39 and surface 37 rollers or wheels 40 having an axis of rotation which e.g. has been attached to profile 39, in which case the wheel or roller is rotatable free from profile 39 and in engagement with the surface 37 of the wall 38. The application 40 wheels requires shafts which extend perpendicular to each other, the forces then are taken up in two perpendicular horizontal directions and therewith the pontoon is guided upon the profile 8 such that displacement only are possible in vertical direction, vide FIG. 13.

I claim:

1. A method of constructing a column-like marine structure including a column which extends upwardly from a base portion adapted to rest on the water bottom, comprising the steps of:

(1) constructing an arrangement of floats;

(2) placing the arrangement of floats on a working area which can be flooded;

(3) placing upon the arrangement of floats a first column part comprising at least the base portion, which base portion is constructed to have buoyancy;

(4) flooding said working area to thereby float the arrangement of floats and said first column part carried thereby;

(5) moving the arrangement of floats and said first column part to deeper water;

(6) ballasting the floats to sink them while maintaining the buoyancy of said first column part;

(7) removing the arrangement of floats from beneath the first column part;

(8) ballasting said first column part to thereby sink it to the bottom of the deeper water, which is of a depth such that said first column part extends above the water surface;

(9) assembling the floats around and coupling them to said first column part;

(10) constructing at least one further column part on the top of said first column part;

(11) lifting the column from the water bottom by buoyancy of said floats; and

(12) floating the assembly of floats and column to its destination and there ballasting the column to sink it onto the water bottom.

2. Method according to claim 1, wherein in step (3) the arrangement of floats is placed on a prepared flat area in water subject to tides of a depth such that the floats rest on the prepared area during periods of low tide and float during periods of high tide.

3. Method according to claim 1, wherein in step (3) the arrangement of floats is placed on a flat bottom in an area adapted to be closed with respect to surrounding water and from which water can be removed, such as the area of a dry dock.

4. Method according to claim 2 or claim 3, wherein the arrangement of floats and said first column part in step (5) is moved to a water depth in which said first column part can float at a level at which the lower end of its base is spaced from the water bottom a distance at least as great as the height of the floats.

5. Method according to claim 1, wherein step (10) of constructing at least one further column part is carried out in the quiet water of a harbour or like area protected from the sea.

6. Method according to claim 1, wherein step (10) of constructing at least one further column part is carried out inside a dock area.

7. Method according to claim 1, wherein in step (9) the floats are coupled to said column for movement relative to the column in only a vertical direction.

8. Method according to claim 7, wherein in step (11) the column is lifted vertically with respect to the column by winching from the top of the floats cables attached to the lower end of the column.

9. Apparatus for use in the manufacture of a column-like marine structure having a base portion adapted to rest on the water bottom at a selected site, a large part of which structure is manufactured in an area remote from the site, floated to the site and there lowered onto the bottom of a body of water, said apparatus comprising:

a plurality of floats adapted to be assembled to form an annular arrangement of floats on which the base of said structure may be supported and which surrounds an area which substantially corresponds to the contour of the outer surface of the column portion of the structure to be manufactured, so that they can be assembled around the column of a partly manufactured structure, said floats including guide means adapted to cooperate with the contour of the outer surface of the column to limit relative movement between the arrangement of floats and the column structure to movement in a vertical direction, and coupling means supported on said float assembly and adapted when surrounding the column of a partly manufactured structure to be coupled to the structure for displacing said float assembly and said structure either upwardly or downwardly relative to each other in a vertical direction and for locking the float assembly to the column at an adjusted vertical position.

10. Apparatus according to claim 9, wherein said coupling means comprises a plurality of cables each connected at one end to winch means supported upon said float assembly and each adapted for connection at their other end to the lower end of said structure.

11. Apparatus according to claim 10, wherein said winch means comprises at least one winch supported on each float of the assembly.

12. Apparatus according to claim 9, wherein each float has upper, lower, inner and outer surfaces and side surfaces disposed at an angle with respect to the inner surface and provided with flanges for detachably interconnecting the floats, and wherein each float has at least at its upper surface a tension bar which bridges the flange connection of two interconnected floats.

13. Apparatus according to claim 12, wherein the inner surface of each float faces and is complementary to the opposing outer surface of the column structure, and wherein the side surfaces are disposed at such an angle that the inner surface of the interconnected floats substantially corresponds to the outer profile of the column.

* * * * *